US006840068B2

(12) United States Patent
Pasin et al.

(10) Patent No.: US 6,840,068 B2
(45) Date of Patent: Jan. 11, 2005

(54) APPLIANCE FOR CLEANING AND REFRESHING FABRICS WITH A BUILT-IN WORKING INDICATOR

(75) Inventors: Merih Pasin, Brussels (BE); Tim Maria Joris Van Hauwermeiren, Buggenhout (BE); Carol Smith, Brussels (BE)

(73) Assignee: Whirlpool Corporation, Benton Harbor, MI (US)

( * ) Notice: Subject to any disclaimer, the term of this patent is extended or adjusted under 35 U.S.C. 154(b) by 307 days.

(21) Appl. No.: 10/017,644

(22) Filed: Dec. 14, 2001

(65) Prior Publication Data

US 2002/0154011 A1 Oct. 24, 2002

(30) Foreign Application Priority Data

Dec. 14, 2000 (EP) ..... 00870302

(51) Int. Cl.[7] ..... D06B 1/00

(52) U.S. Cl. ..... 68/5 C; 68/12.26; 68/222; 223/51; 34/622

(58) Field of Search ..... 68/12.26, 12.27, 68/6, 5 C, 222; 223/51, 70, 73, 76; 34/621, 622

(56) References Cited

U.S. PATENT DOCUMENTS

| | | | | | |
|---|---|---|---|---|---|
| 3,601,292 | A | * | 8/1971 | Bliss | 68/6 |
| 3,752,373 | A | * | 8/1973 | Smith | 223/51 |
| 3,849,815 | A | * | 11/1974 | Frauendorf | 8/149.1 |
| 3,905,125 | A | * | 9/1975 | Hubner | 34/622 |
| 4,916,439 | A | * | 4/1990 | Estes et al. | 340/679 |
| 5,528,912 | A | * | 6/1996 | Weber | 68/6 |
| 5,730,006 | A | * | 3/1998 | Conley | 68/6 |

FOREIGN PATENT DOCUMENTS

DE 2410279 A * 9/1974 ..... D06F/59/08

* cited by examiner

*Primary Examiner*—Bruce F. Bell
*Assistant Examiner*—Joseph L. Perrin
(74) *Attorney, Agent, or Firm*—John F. Colligan; Robert O. Rice; Stephen Krefman

(57) ABSTRACT

The present invention is primarily directed to an appliance suitable for refreshing/cleaning cloth items in a refreshing/cleaning cycle, said appliance comprising a collapsible or expandable container that is made from a material that defines an interior void space, a container opening, a humidity provider, a heating element, at least one vent and/or filter, and an air circulation device, wherein said appliance further comprises a device to prevent accidental opening of the appliance's container by the user while a refreshing/cleaning cycle is running.

12 Claims, 4 Drawing Sheets

APPLIANCE FOR CLEANING AND REFRESHING FABRICS WITH A BUILT-IN WORKING INDICATOR

BACKGROUND OF THE INVENTION

1. Field of the Invention

The present invention relates to appliances useful for cleaning and refreshing fabrics. The present invention is especially directed to such an appliance that comprises a means to prevent its accidental opening while a refreshing/cleaning cycle is running.

2. Description of the Related Art

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and the solvent must be reclaimed, making the process unsuitable for in-home use. Hence, dry-cleaning has traditionally been restricted to commercial establishments making it less convenient and more costly than in-home laundering processes.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package.

Unfortunately, such in-home processes are designed for use in a conventional clothes dryer, or the like appliance. Such appliances are not always readily available, and they are often uneconomical. Moreover, in many countries clothes dryers are simply unnecessary. For example, in many warm tropical regions people do not typically own clothes dryers because their clothes can be dried year-round by hanging them outside in the sun. In the areas of the world where people do not typically own clothes dryers, products that require a heating appliance, such as a clothes dryer, are of little or no value.

Steamer cabinets have also been utilized in the past to treat fabric articles with heavy doses of steam. Unfortunately, past steam cabinets were largely uncontrolled with respect to temperature and humidity. The cabinets were generally large appliances that were not portable. And due to the large amount of steam used a drying step is often required that puts strain on the fabrics. The drying step also requires additional time and energy, and often results in undesirable shrinkage.

Thus, there was a need to develop a domestic, non-immersion cleaning and refreshing process, and cleaning and refreshing compositions for use therein, which provides acceptable cleaning without the need for a tumble dryer. Moreover, there was a need for appliances that can regulate both temperature and relative humidity within a container during a domestic, non-immersion cleaning and refreshment process, wherein dry clean only fabrics are cleaned, de-wrinkled and refreshed. Such appliances were developed, which comprise a container, preferably collapsible, having an interior void space for hanging at least one cloth item, and a built-in mechanism to control temperature and humidity levels inside the container and dispense a refreshing/cleaning composition onto the treated cloth item. Such containers and/or processes are disclosed for example in the PCT application WO00/52249 to Procter & Gamble, or WO2000/US14910 (application number) to Procter & Gamble.

However, the cloth refreshing/cleaning appliances as above described still present some disadvantages. Firstly, such refreshing/cleaning appliances use controlled temperature and humidity inside the void space of the appliance, and they treat the garments by dispensing a refreshing/cleaning composition inside the void space of a container. However, it is very easy for the user to open the container of the refreshing/cleaning appliance while it is running, thus modifying the normal temperature and humidity conditions, and letting the refreshing/cleaning composition out. Thus, such accidental openings while the appliance clearly undesirable to keeping good fabric treating conditions inside the void space of the container, and such accidental openings can badly affect the overall performance of the appliance. Secondly, it has been found that it is highly beneficial for users of such appliances to have ready-to-use usage instructions. One important reason for creating such appliances was to improve simplicity and efficiency in the daily treatment of clothes. The simplicity of the refreshing/cleaning process that is inherent to such appliances can be dramatically improved if the appliance itself comprises means to indicate the user how to run a refreshing/cleaning cycle.

For the reasons cited above, It is a main object of the present invention to provide a cloth refreshing/cleaning appliance that comprises a safety means to prevent accidental opening while a treating cycle is running, and especially, a means to warn the user that the appliance is running.

It is a further object of the present invention to provide the consumer with an appliance that comprises means that indicate and help the user with built-in instructions on how to use said appliance and run a refreshing/cleaning cycle in a safe way.

SUMMARY OF THE INVENTION

The present invention is primarily directed to an appliance suitable for refreshing/cleaning cloth items in a refreshing/cleaning cycle, said appliance comprising a collapsible or expandable container that is made from a material that defines an interior void space, a container opening, a humidity provider, a heating element, at least one vent and/or filter, and an air circulation device, wherein said appliance further comprises a means to prevent accidental opening of the appliance's container by the user while a refreshing/cleaning cycle is running.

BRIEF DESCRIPTION OF THE DRAWINGS

The invention will now be explained in detail with reference to the accompanying drawings, in which:

FIG. 3A shows the container in open configuration with the two free corners of the container fabrics looped to the lead member of their corresponding horizontal zipper; FIG. 3B shows the container in closed configuration with the lead member of the vertical zipper inserted in the locking mechanism and locked there into.

DESCRIPTION OF THE PREFERRED EMBODIMENT

Figure 1:
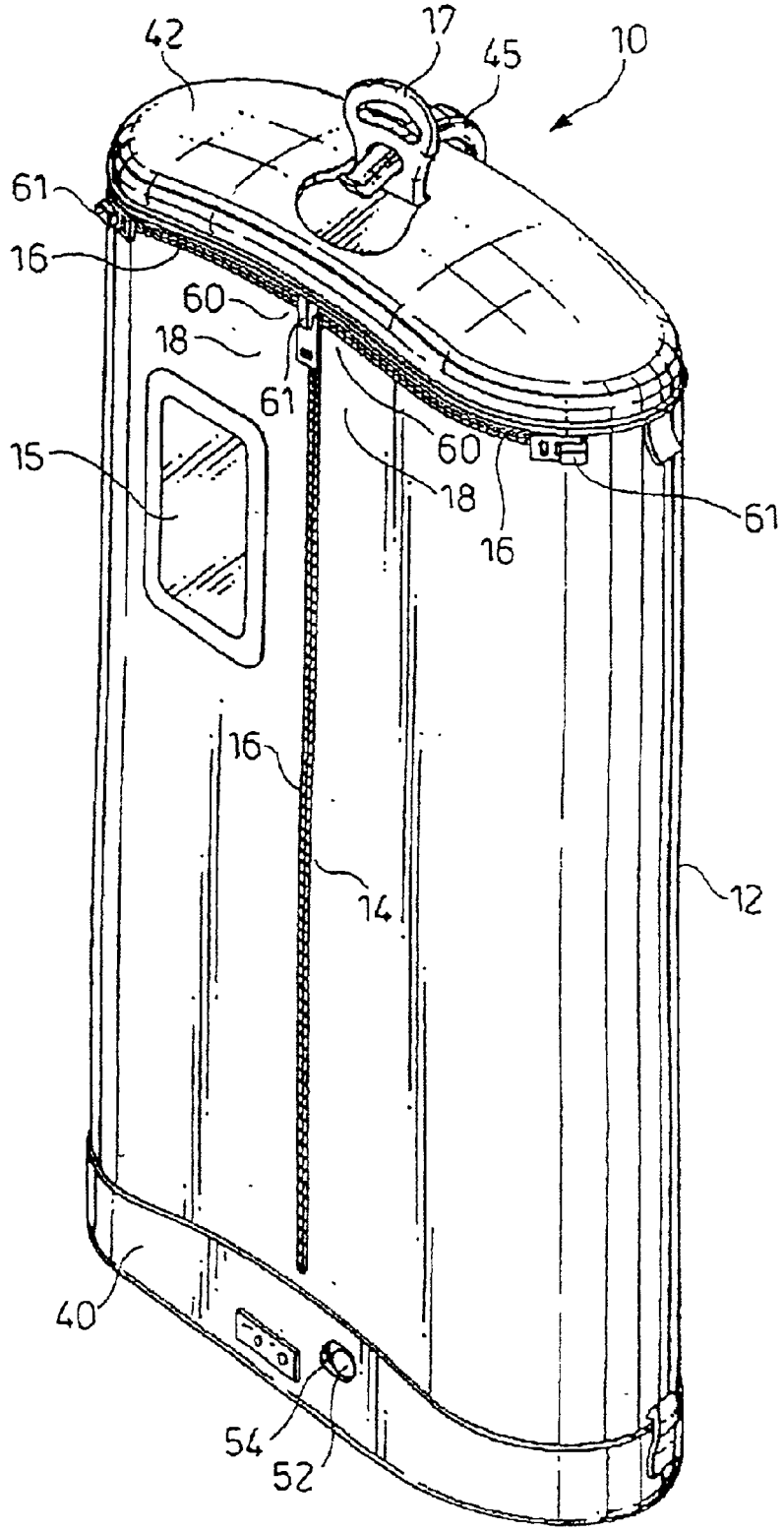
FIG. 1 is a perspective view of an appliance according to the present invention, in its expanded configuration.

The present invention provides appliances for cleaning and refreshing fabric articles in a domestic, non-immersion process. The appliances are suitable for use in a cleaning and refreshing method that requires at least two steps, and preferably three. The temperature and relative humidity within the fabric treatment appliance can be manipulated and controlled to create a warm, humid environment inside the container of the fabric treatment appliance. This controlled environment volatilizes malodor components in the manner of a "steam distillation" process, and moistens fabrics and the soils thereon. This moistening of fabrics can loosen pre-set wrinkles, and because the fabric articles are hung in the container new wrinkles do not form. Proper selection of the amount of the vapor, and specifically the amount of water used in the process and, importantly, proper venting of the container in the present manner can minimize shrinkage of the fabrics. Moreover, if the container is not vented, the volatilized malodorous materials removed from the fabrics, which are not captured by the filter if present, can undesirably be re-deposited thereon.

Relative humidity is a well-known concept to those in the fabric care arts. As used herein, "relative humidity" means the ratio of the actual amount of water vapor in the air to the greatest amount the air can hold at the same temperature.

Temperature and relative humidity controllers are well known to those skilled in the art, as are passive and active controllers, As used herein, an "active" controller is a controller that reads an input and supplies feedback to the device being controlled and that device adjusts based on the feedback received. A "passive" controller, as used herein, is a controller that turns a device on or off, or opens or closes a device, based on a predetermined setting such as time. For example, a passive temperature controller would turn on a heating element or close a vent to increase the temperature in a given environment and after a certain period of time the heating element is turned off or the vent is opened. In contrast, an active temperature controller reads the temperature and if, for example, the temperature is too low, the power to the heating element is increased or the vent is closed to increase the temperature.

As used herein "fabric articles" is meant to encompass any and all articles of manufacture that are made at least partially of a natural or manmade fibrous material. Examples of fabric articles include, but are certainly not limited to: toys, shoes upholstery, garments, carpets, clothes hats, socks, towels, draperies, etc.

The fabric care appliance of this invention can take a variety of forms. It is an essential feature of the appliances of the present invention, that they comprise a container that encloses the fabric items being cleaned and refreshed. By "encloses", it is meant that the fabric articles are enclosed in the container, but that the container includes one or more vents. It is another essential feature of the appliances of the present invention that the container comprises an opening to access the fabric articles, and preferably, there is a bar, hook or other device on which to hang the fabric articles.

The container preferably has only one wall configured like an egg shell, as shown in FIG. 1. It has been found that the vapor, and subsequently the active ingredients, preferentially condense in the corners and along the sharp edges of a more conventional rectangular shaped cabinet. This is not to say that the methods of this invention cannot be conducted in rectangular cabinets; they can. Regardless of its shape, every container has an "open volume" which as used herein means the volume of the container when it is in use. The containers of this invention are collapsible or expandable and have a substantially reduced volume in their closed or collapsed state.

Referring now to FIG. 1, which is a schematic perspective representation of a fabric treatment appliance (10) according to the present invention, the collapsible or expandable, preferably flexible walls (18) of container (12) are preferably made of a flexible material, which is preferably a lined fabric material. And more preferably the lining is a coating applied to the fabric by methods known to those skilled in the art such as transfer coating, direct coating. The fabric is preferably selected from the group consisting of cotton, polyester, nylon, rayon and mixtures thereof, and the lining is preferably selected from the group consisting of silicone, polyurethane, polyvinyl chloride and mixtures thereof. Collapsible or expandable walls (18) of container (12) define an interior void space (19), which is preferably supported by one or more rigid, yet collapsible frames. These frames can be separate from one another, or they can be a unitary structure. Interior void space (19) is preferably viewed via window (15) if collapsible or expandable walls (18) are made of an opaque material.

It is understood that while the treatment appliance (10) is shown in a rounded rectangular configuration, the present invention is not meant to be so limited. Other structural configurations are appropriate for this invention, for example, pyramid, spherical, hemi-spherical, two-sided/garment bag and other configurations. The treatment appliance (10) can be of any appropriate size and shape to achieve the desired volumetric sizes disclosed herein. Fastener (16), which seals opening (14), can comprise virtually any known sealing device such as zippers, tape, ZIP LOCK® seals and hook and loop type fasteners, for example VELCRO®.

Figure 3A:
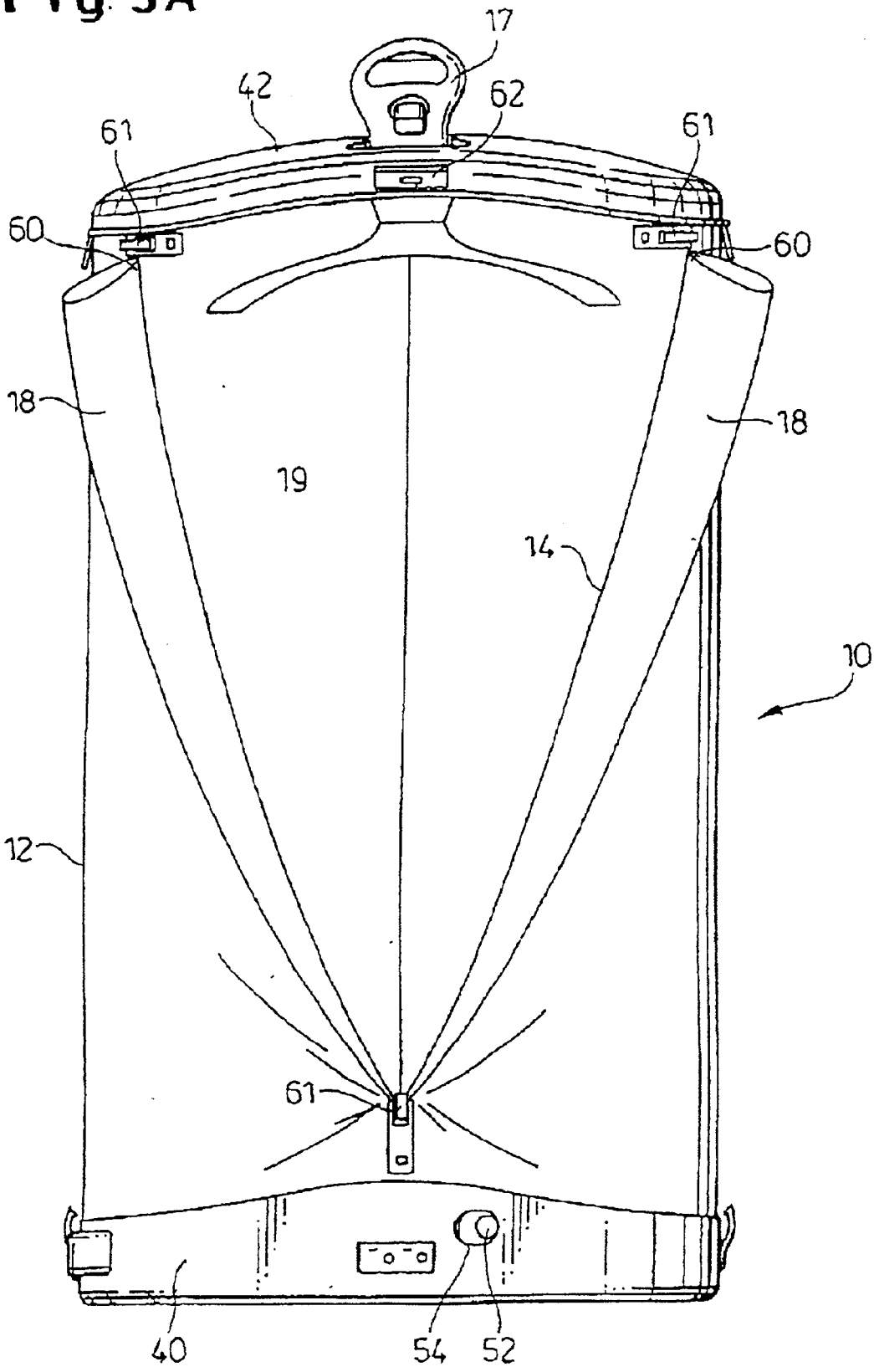
FIGS. 3A and 3B are diagram views showing a preferred closing system for the appliance's container—comprising one vertical and two horizontal zippers—and the locking mechanism for securing the lead member of the vertical zipper in closed position.
Figure 3B:
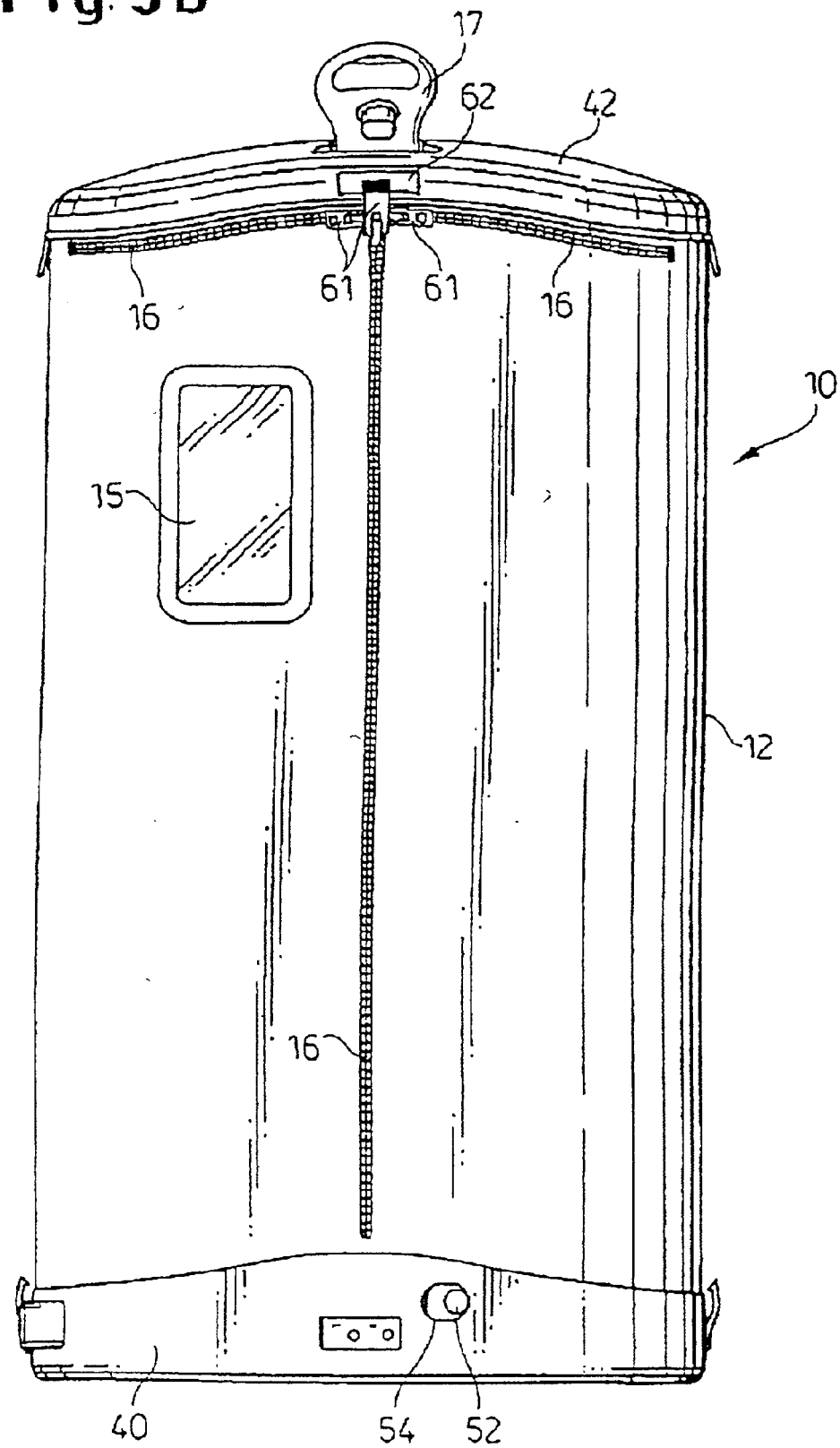

In a preferred embodiment of the present invention, the container (12) is closed by more than one zipper, more preferably, three zippers (16), as shown in FIGS. 3A and 3B. Preferably, two of them are horizontal, and the third one is vertical. The container (12) further comprises a means to ensure that, once all three zippers (16) are in the closed position and the treatment appliance (10) is ready for a new treatment cycle, all three zippers (16) are secured and stay in the closed position. Such a securing means (62) will ensure that none of the zippers (16) can be unzipped, and thus this will ensure that the container (12) cannot be opened while the cloth refreshing/cleaning apparatus (10) is running. In one embodiment, the securing means (62) is achieved by providing two horizontal zippers that are looped to themselves, as shown in FIG. 3A. By "looped to themselves", it is meant that each of the two free corners (60) of the container fabrics is attached to the lead member (61) of the zipper that is closest to said free corner (60), as shown in FIG. 3A. By looping the horizontal zippers to themselves, they are prevented from opening if the vertical zipper is not in the open position. The reason is, for sliding the lead member of the horizontal zippers, the corresponding free corner needs to be able to move, since it is attached to said lead member. If the vertical zipper lead member is locked in closed position to the top of the appliance, the free corners of the container fabrics (60) are prevented from moving as well, and as a consequence, it is impossible to slide the horizontal zippers in open position.

In order to lock the lead member of the vertical zipper to the top of the container as shown in FIG. 3B, so as to secure said container in closed position, it is necessary to provide the top of the container and said lead members with cooperating means that will act as a "lock and key" system. In a preferred embodiment of the present invention, the lock and key system (62) is an electrical mechanism. Said electrical mechanism is located on the top of the container, preferably onto the rigid top portion (42) as hereafter described. Said electrical mechanism comprises a moving protrusion that is mounted on an actuator to lock/unlock the lead member of the vertical zipper. Said actuator can be a solenoid, a wax motor, or any other type of actuator that can move the protrusion in lock/unlock positions by using an electric signal. By wax motor, it is meant a motor that uses an electric signal to collapse/expand foam, an alloy, wax, or a gel, or any other kind of material that reacts to electricity, in order to move the moving protrusion of the actuator. The actuator that is preferably mounted on the rigid top portion (42) of the appliance's container (12) is preferably coupled to a micro switch that detects in which—locked or unlocked—position, the actuator is. Said micro switch is linked to an electronic board (or PCB), that monitors the appliance's operation. More specifically, the micro switch and PCB will preferably be programmed such that it is possible to start a cleaning/refreshing cycle only if the container is fully closed, i.e. if the lead member of the vertical zipper is inserted into the actuator, and locked by the moving protrusion.

Figure 2:
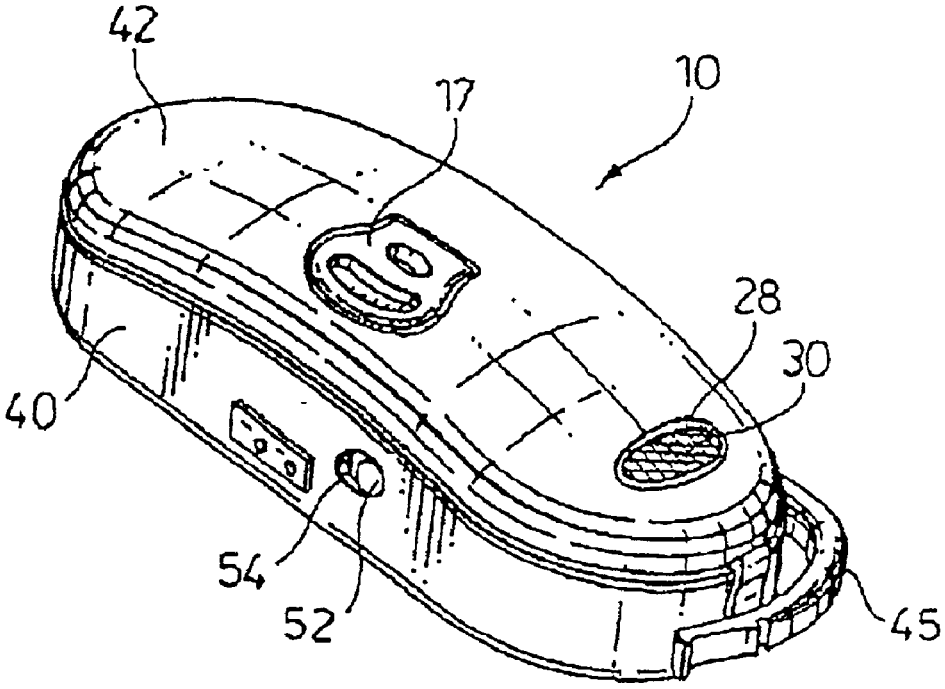
FIG. 2 is a perspective view of an appliance according to the present invention, in its collapsed configuration.

The containers of the present invention preferably comprise a rigid top portion (42) and a rigid bottom portion (40) that form, once gathered, a receptacle for the container when it is collapsed, as shown in FIG. 2. If a frame is employed, the rigid portions (40, 42) of the container (12) can serve a support for the frame, or the frame and the rigid portion can be separate items that are not connected to one another. Preferably the frame or frames form a flexible, collapsible structure that when expanded forms a semi-rigid, three dimensional structure. Examples of collapsible structures are known, for example, in U.S. Pat. No. 5,038,812, which issued on Aug. 13, 1991, to Norman. The entire disclosure of the Norman patent is incorporated herein by reference. In general, flexible, collapsible frames, such as those found in Norman, are formed from material that is relatively strong but nevertheless flexible enough to allow it to be collapsed. An exemplary frame material is flat spring steel having a rectangular cross section with dimensions of 1.6 mm in width and 76 mm in length. The frame or frames can be sewn, glued or otherwise attached to the interior or the exterior of the treatment bag. Likewise, the frame or frames can be free standing with the treatment bag material hanging loosely over, or being expanded by the frame.

As is discussed briefly above, the appliance (10) of this invention is collapsible, as shown in FIG. 2. That is, the container (12) can be folded to substantially reduce its volume. More preferably, the container (12) collapses into a receptacle that can be formed by the rigid portions (40, 42) of the container, or the receptacle can be a separate item. The receptacle need not be rigid, but can be any suitable storage unit for the collapsed container. Preferably the container (12) comprises a handle (17) that makes it easier to transport the collapsed container from one place to another. Even more preferably, the handle (17) also serves with the exterior hanging means (45), which is used to hang the appliance in use and can be used as a handle to carry receptacle when appliance (10) is collapsed.

To facilitate numerous cycles of collapsing and un-collapsing, the collapsible or expandable, preferably flexible material must be reasonably durable. By durable it is meant that the container (12) should resist mechanical and chemical stress, that is the material should not swell, soften or develop cracks, holes, or other defects during its normal use. Likewise, if the container (12) is constructed of a lined material, the lining should not deteriorate or exfoliate. In one preferred embodiment of this invention, the container (12) is also thermally insulated with additional material, or even more preferably, the flexible material is a thermally insulating material. But as is discussed below in the Method description, there is a need for relatively quick "cool-down" of the bag, which allows for condensation of the perfume on the fabrics. Thus, the bag should not be perfectly insulated.

The collapsible or expandable, preferably flexible, material should have a natural vapor permeability not higher than 3000, preferably, not higher than 2000, and more preferably not higher than 1000 grams of water/$m^2$/day. Vapor permeability can be measured by a standardized test such as the ASTM E96 test, which will be known to those skilled in the art. The collapsible or expandable, preferably flexible, material can be essentially vapor impermeable, but it may be desirable for the container walls to have some limited permeability so the container can "breathe". Also, the collapsible or expandable, preferably flexible, material should be resistive to chemical corrosion, and ultra violet light. The various materials listed below as suitable cleaning and refreshment composition additives should not damage the container material over time. Likewise, the appliances of this invention may be used near a window wherein the sunlight might fade or otherwise damage the material. The container material should be selected to minimize this degradation due to natural sources. Suitable collapsible or expandable, preferably flexible, materials can be purchased from the Milliken Corp., in South Carolina, or the Sofinal Corp., in Belgium The containers of this invention can be formed from one sheet of collapsible or expandable, preferably flexible, material or from multiple sheets of material that are joined together in any appropriate manner. Those skilled in the art can contemplate many ways to join multiple sheets of material together to form a container. For example, the sheets can be sewn together, stapled, adhesively bonded, heat bonded, sonic bonded, or attached to one another by means that are known. The seams of container (12), if properly engineered, can form the container vent. By properly engineered, it is meant that the welds, stitches, bonds, staples, etc. of the container should be spaced so as to vent the desired amount of air during operation. Those skilled in the art will be able to determine the proper seam construct to achieve the desired venting without undue experimentation.

It is another essential feature of appliances according to the present invention, that said appliances further comprise: at least one vent (28); a temperature controller that is preferably active and is capable of changing and maintaining the air temperature within the interior void space (19) of container (12); a humidity provider that is preferably passive and is capable of changing and maintaining the relative humidity of the air within the interior void space (19) of container (12); a heating element, which is capable of heating liquids to produce vapors and which can run dry to heat air; and an air circulation device, for example, a fan. Preferably, for the optimum deodorization, it preferred to have air velocities around the garment between 0.05 to 10 m/s, more preferably between 0.1 and 5, most preferably between 0.5 and 2 m.s–1. Preferably, the active temperature controller, the passive humidity controller, the heating element, and the air circulation device are all within the interior void space (19) of container (12). Necessarily air circulation device has an air inlet and an air outlet, and it is preferred, that both air inlet and air outlet are located within interior void space (19) of container (12) so that at least a portion of the air within the interior void space (19) of container (12) is recirculated. Likewise, air outlet is at least about 30 cm, preferably at least about 25 cm, and more preferably at least about 20 cm from vent 28 such that a portion of the air circulated within the interior void space (19) of container (12) is vented to the exterior of the container.

The vent is preferably selected from the group consisting of the natural permeability of the flexible material, seams created between sheets of the flexible material, seams between the container opening and the flexible material, a void space in the container material, and mixtures thereof. By "void space in the container material" it is meant that the vent can be any appropriately sized hole or opening. The filter (30) can also be a component of the appliance. The filter (30) is preferably located at the top of the appliance or at the bottom in either close proximity to the fan, thereby removing the need for a vent and the appliance may then work in close system or under the cover plate in close proximity to the heating element. Preferably the filter (30) is in close proximity, e.g. adjacent, the vent. Even more preferably the appliance, most preferably the vent comprises a humidity sink, e.g. condenser for condensing vapors before they are emitted from the container. Preferably the filter comprises an absorbent material, for example, activated carbon, to absorb fugitive chemicals, perfumes, and malodorous compounds before they are emitted to the exterior of the container. Most preferably, the filter is a low-pressure filter that has a low resistance to air. Typical of such filter are commercially available from AQF under the trade name CPS® or from MHB filtration. Preferably, part up to the total surface of the air circulation device, e.g. fan may be covered by the filter. If part of the air circulation device is covered, lost of the perfume through the filter is minimized whilst when the whole air circulation device is covered one can have the air circulation device automatically switched off upon the end of the cycle thereby enabling deposition of the perfume onto the garment. Condensers and filters are well known to those skilled in the appliance arts.

The appliances of this invention can utilize hot vapors to clean and refresh fabric articles as described above. The vapors are typically created within the container by vaporizing a cleaning and refreshment composition, which comprises water and actives. The water and actives, that is, the "cleaning and refreshment composition", or "fabric treatment composition" (these two terms are used interchangeably throughout this description and are intended to mean the same thing), can be added to the container in any appropriate way. The composition can be poured into the bag, poured into a reservoir that feeds into the heating element/humidifier, canisters can be used to inject the composition, or an absorbent substrate saturated with the composition can be placed in the bag. Substrates and compositions suitable for use in the methods of this invention are described in greater detail below. It is understood that those skilled in the art will know of other methods of adding actives to the container and those methods are within the scope of this invention.

As discussed above, the appliances of this invention comprise a heating element and an air circulation device that work together to vaporize and distribute the cleaning and refreshment composition. By "work together" it is meant that the heating element is in fluid communication with the air outlet of the air circulation device such that as air is circulated within the interior void space of the container it contacts the heating element. Moreover, it is especially preferred that the heating element be in fluid communication with a fabric treatment composition that is vaporized by the heating element. The fabric treatment composition is circulated throughout the interior void space of the container as air is circulated across the heating element carrying the vaporized fabric treatment composition. The fabric treatment composition is contained within the cartridge (52) having a cartridge outlet, wherein the cartridge outlet is in fluid communication with the heating element via a cartridge receiver (54).

The mechanical elements of appliance (10) comprise, as a minimum, a humidity provider, a heating element, an air circulation device, and a temperature controller. In a preferred aspect of this invention, the heating element serves to heat both the air and to vaporize the cleaning and refreshment composition. The vaporized cleaning and refreshment composition raises the humidity within the interior void space (19) of container (12). The humidity provider is generally passive, that is it is preprogrammed to turn on and off based on the amount of vapor necessary to achieve the desired humidity. In contrast, temperature controller is preferably active, that is the temperature is read with temperature probe and this temperature is sent back to the temperature controller. Based on the input from the temperature probe, the temperature controller raises or lowers the temperature of the heating element. Alternatively, the heating element can be turned on or off based on the input from the controller. Each of these mechanical elements will be known to those skilled in the appliance arts, and the size and power of each element can be selected based on the volume of the container. Many manufacturers market these elements, such as, Etri in France, Blackmann in Austria, and IRCA in Italy.

While the appliance described above arguably performs the function of a classic "steamer", it additionally heats and circulates dry air throughout the interior of the container. By this method both humidity and temperature can be controlled independently, which is not the case with prior steam generating appliances.

Alternatively to the use of a steaming element such as the main heating element, the vapor can be supplemented by a nebulizer, atomizer or the like device (not shown), which can be used to spray a fine mist of volatile and non-volatile cleaning and refreshment compositions. In such a case, the main heating element remains, which is used to raise the temperature inside said container (12). In addition to distributing a fine mist of the cleaning and refreshment composition throughout the interior of the container, the nebulizer will preferably be used as the humidity provider as well. Preferably the nebulizer is an ultrasonic device, most preferably providing droplets size between 1–60 microns, most preferably between 1–40 microns. Nebulizers, atomizers and the like devices that are appropriate for use in the present invention are well known to those skilled in the art. A suitable device for use herein is a nebulizer, which has an ultrasonic nozzle. Typical of such nebulizer is commercially available from Sono Tek Corporation, 2012 route 9W Building 3 in Milton N.Y. 12547 under the trade name Acu Mist®. If used, it is preferred to have frequency set up to at least 60 kHz, most preferably to at least 100 kHz so as to obtain droplets sizes below 60 microns, more preferably below 50 microns, most preferably below or equal to 40 microns. Still other examples of such devices can be purchased from the Omron, Health Care, GmbH, Germany, Flaem Nuove, S.p.A, Italy. Likewise, aerosol delivery systems, which are well known to the art, can be used to deliver the cleaning and refreshment compositions. More preferably, the nebulizer comprises protected cells. Indeed, a problem encountered with the use of cell containing nebulizer is their contamination from contact with the cleaning/refreshing composition, thereby causing build-up on the cell. As a result, the lifetime of the cell is shortened. It has now been found that protection of the cell, in particular by contacting the cell with a protective medium, e.g. demineralized water, the latter being covered by a membrane, so that this system is closed, i.e. leak-free, solved this problem. Accordingly, the membrane is defined as providing the closing of the system but does not prevent the energy waves transmittal. Subsequently, the cleaning/refreshment composition is added on top of this system. As a result, the lifetime of the cells are greatly enhanced. One advantage of this system is that it can be run empty of cleaning/refreshment composition without the risk of destroying the cell and thus the nebulizer. Preferably, the membrane is a layer made of plastic film, and/or made of metal. Typical description of such appliance can be found in a co-pending application BE 9900683 filed 14, Oct. 1999 in the name of Brodsky SPRL. This finding is all the more surprising as previous attempts to solve this problem were by level detectors. However, this did not prevent the build-up from the cleaning/refreshment onto the cell.

In addition, it has also been found a means to improve the low output of the nebulizer. Indeed, another problem encountered with conventional nebulizer is that of the coalescence of the droplets. Indeed, as the droplets are emitted into the air, the higher they are the more they coalesce therefore giving bigger droplets and thus falling back into the basin of the nebulizer. The present invention solved this problem in a simple manner by the addition of a blowing means like a fan, which is preferably located on top of the nebulizer so as to provide a horizontal air flow and hence directing the flow of small droplets through a grid. Typical description of such appliance can be found in a co-pending application BE 9900682 filed 14, Oct. 1999 in the name of Brodsky SPRL.

Fabric articles can be suspended in the interior void space (19) of the treatment appliance (10) by any appropriate method. One such method uses a bar that is provided inside the container (12). The garments hung in treatment appliance (10) can also be weighted or stretched to improve wrinkle reduction. Hanging weights and stretching devices will be known to those skilled in the art. Preferably, the garments to be treated are mechanically stretched after placing them into the container and before starting the process. This stretching or so-called tensioning of the garment helps the relaxation of wrinkles during the process. Preferred stretching systems include weighted as well as lightweight compactable or retractable stretching systems, wherein the system comprises a tensioning device like a spring. The latter systems have the benefit of not adding extra weight to the cleaning and refreshing appliance, along with the possibility of adjusting tensioning force and direction as required. Preferably, these systems are mounted inside the container at its bottom. One example of such as system is a rollerblind that is conventionally used as sun filter for cars and commercially available from Halfords. This system is a rollerblind that can be extended or compacted by means of a roll-up spring mechanism. Only slight modification of this system is needed to adapt it to the tensioning of garment. One preferred adaptation involves attaching the housing of this system at the bottom of the appliance and providing one or more clamp at the other side so that the clamping and thus the stretching or tensioning of the garment in the appliance is obtained. The tension of the spring can also be adjusted to the desired stretching force for a given garment. The size of the clamp can vary so that more than one clamp is attached to this system. Still, another variation involves having only one clamp that run along or partly along the blind tensioning system located opposite the housing of the system.

Treatment appliance (10) can be free standing with the support of a rigid frame, or it can be suspended by a hanging member from a support means (not shown). If the treatment appliance (10) is suspended by a hanging member no frame is required although frames are generally preferred to control and maintain the shape and volume of interior void space. In a preferred embodiment of the present invention the container further comprises a rigid bottom portion (40), a rigid top portion (42) or both. These two rigid portions can be used to support the frame, house the mechanical elements of appliance (10), and/or to serve as a housing for the collapsed container. Moreover, rigid bottom portion (40) and rigid top portion (42) can be designed to enhance the aesthetic characteristics of the appliance, that is, there need not be any functionality to the rigid portions.

The cloth refreshing/cleaning appliances as above described still present some disadvantages. Indeed it has been found that it is possible for the user to accidentally open the appliance (10) while it is running. This is highly undesirable since such refreshing/cleaning appliances use controlled temperature and humidity inside the interior void space (19) of the appliance (10), and they treat the garments by dispensing a refreshing/cleaning composition inside the void space (19) of the container. However, it is very easy for the user to open the container (12) of the refreshing/cleaning appliance while it is running, thus modifying the normal temperature and humidity conditions, and letting the refreshing/cleaning composition out. Thus, such accidental openings while the appliance is running, are clearly undesirable to keeping suitable fabric treating conditions inside the void space of the container.

The present invention solves the above problems by providing for a cloth refreshing/cleaning appliance that comprises a safety means to prevent accidental opening while a treating cycle is running, and especially, a means to warn the user that the appliance is running. In the following, said means is generally referred to as "working indicator".

In a first embodiment of the present invention, the working indicator is preferably a visual indicator, which is more preferably achieved by at least one lamp that produce(s) a light of given intensity. Most preferably, at least one lamp is placed inside the appliance's container (12), and its light passes through the container's walls, and said lamp is lit during the refreshing/cleaning cycle, through the walls of the appliance's container. By "lit during the refreshing/cleaning cycle", it is meant that the lamp produces some light, however the intensity of the light that is produced can, and preferably will, vary throughout the refreshing/cleaning cycle. The variations should more preferably correspond to the main different steps of said cycle. In case the intensity of the lamp changes throughout the refreshing/cleaning cycle, said an automatic controller changes the lamp intensity. Such light controllers are well known in the art and will be appropriately chosen by the skilled person. For example, the light controller is achieved by a light dimmer of 20 W and 12V DC. The light is preferably transmitted through a diffusing transparent or semi-transparent window located at the bottom of the appliance. The light then diffuses inside the appliance's container and passes through the container's walls. In the present case, the light controller is coupled to the microchip that drives the different steps of the refreshing/cleaning cycle, so that the light intensity adapts to the different cycle steps. An example is given hereafter. Also optionally but preferably, other parts of the appliance are equipped with lightning sources, such as the recess for inserting the product container, as well as a digital screen that gives information to the user about the refreshing/cleaning cycle that is running, and other functionalities of the appliance.

In a second embodiment of the present invention, the working indicator is an auditive indicator. As for the visual indicator, the auditive indicator preferably adapts the intensity and frequency of the sound to the different steps of the refreshing/cleaning cycle. These variations are also achieved by connecting the sound source to a controller that is coupled to the microchip driving the refreshing/cleaning cycle steps. Different types of sound sources exist that can be appropriately chosen by the skilled person. For example, a sound source that produces voice messages can be used, which will give clear usage instructions to the user. In any case, for safety and comfort of use reasons, the intensity of the sound emitted should preferably not be higher than 90 dB, more preferably not higher than 75 dB, and most preferably not higher than 50 dB. In one embodiment, the fan that is used to circulate air in the interior void space of the appliance's container can also be used to produce a blowing sound that is clearly audible while the appliance is running, In a third embodiment, the working/safety indicator is achieved by a means that creates vibrations at the surface of the appliance's container. Such vibrating systems are well known in the art, for example in the art of making cell phones. Similar systems will be appropriately chosen to provide regular or pulsing vibrations to the structure of the appliance. One advantage of such a vibrating system is that it provides a good working indicator, while being completely silent and/or invisible. Such a system will be particularly beneficial in case the appliance is to be used in a bedroom. As soon as the user touches the surface of the appliance, she/he is warned by the vibrations that the appliance is running, in a silent and invisible way.

In a forth embodiment, the working indicator is achieved by a perfume that is released from the appliance, for example through the vent(s) while the appliance is running. However, given that the perfume will after some time diffuse in all the room, this type of working indicator is most preferably be used in combination with at least another type of indicator. In one example, the perfume is released by the refreshing/cleaning system contained in the appliance itself. The perfume can advantageously be comprised in the refreshing/cleaning composition, and will be released when said composition is vented out of the container.

In a highly preferred embodiment of the present invention, working indicators using different types of human senses (sight, audition, smell, touch) are combined and work simultaneously to better warn the user that a refreshing/cleaning cycle is running.

In another highly beneficial embodiment of the present invention, the working indicator(s) is/are activated once the container is fully closed. This can be achieved by a metallic contact on the zip button, that closes an electrical circuit once the zip is filly closed.

In another particularly beneficial embodiment of the present invention, the working indicators, either visual, auditive, and/or other, not only indicate the user that a refreshing/cleaning cycle is running to prevent accidental opening of the container. They also indicate what the user should do and where so as to run the appliance, thus acting as more or less "intuitive" usage instructions. For example, the working indicators emit light, sound, etc . . . in different places of the appliance, and at different times, to indicate and help the user with what she/he has to do to run the appliance. First, when the user plugs the appliance to the main, a lamp placed in the region of the recess for a refill product container starts glowing and pulsing, to indicate, if necessary, that a container needs to be inserted into the recess. This is achieved by a cartridge light that is for example a 5–10 W, 12V DC lamp, which is connected to an electronic controller that makes the light pulsate. Then, when a container is inserted hereinto, the lamp of the recess stops pulsing and just glows to indicate that a suitable container was appropriately inserted. Second, once the user has placed the cloth item(s) in the container and closed the appliance, she/he presses the start button to begin a new refreshing/cleaning cycle. The on/off switch button is also preferably equipped with a light, of the same type than the light for the container recess. At that time, a sound is emitted (e.g. chimes in the wind) briefly—the intensity of the sound being preferably less than 70 dB, more preferably less than 60 dB—, and the fan that circulates air inside the appliance starts turning slowly and its rotation speed increases during 3 minutes to reach a plateau. Also when the start button is pressed, the vibrating means starts running and the whole surface of the appliance vibrates in a pulsing way. Third, during the refreshing/cleaning cycle, the fan keeps turning continuously at the same speed. Simultaneously, the light intensity through the container increases, to reach a peak at the time the cleaning/refreshing cycle stops, and a perfume is emitted while the composition released inside the container is vented through the container vents. In addition, the surface of the appliance keeps vibrating. Forth, when the treatment cycle finishes, the light inside the container is stopped, as well as the vibrations, and fan. The perfume release is stopped as well. A brief sound of "chimes in the wind" is emitted to notify the user that the refreshing/cleaning cycle has stopped, and it is safe to open the container and remove refreshed and cleaned cloth items. All along, the treatment cycle, it is very important that at least one working indicator be running, so as to warn the user and prevent accidental openings of the container. This is especially true in embodiments of appliances that use certain chemicals that can be unhealthy if in contact with the user in high concentrations, for example ozone.

All the above described controlled means for warning the user that the appliance is running, are most preferably controlled by an integrated circuit that is placed on a board inside the appliance. The PCB (Printed Circuit Board) integrates electronic components for signal acquisition ("in"), such as for example micro-switches mounted on the filter, zipper locking mechanism, cartridge, or a tip-over switch, and also temperature sensors, such as for example thermostats and thermo-fuses connected to the heaters and pump, and also a thermistor at the air exit. After the signal has been treated by the program integrated on the PCB, said PCB then transmits operating signals ("out") to components such as lamps, speakers, or motors, in order to control the light and sound emission, or the actuation of elements like the fan, the pump, the ozone generator, or the ultrasonic nebulizer.

Preferably, the important functions monitored by the PCB are shown while working on a VFD (Vacuum Fluorescent Display) or LCD (Liquid Crystal Display) screen, which is placed on one side of the appliance. More preferably, the main controls can be manually accessed by pressing buttons that are located next to the LCD-type screen. Such buttons include, but are not limited to for example, appliance main on/off switch, sound volume set-up button, fan on/off switch, nebulizer on/off switch, indicators on the level of product in the container, etc . . . The VFD- or LCD-display itself will be used as a means to prevent accidental opening of the container while the appliance is running, since it displays indications on the appliance's operation.

The appliances of this invention must simultaneously clean and refresh fabrics with vaporous compositions, and vent out the malodorous vapors. It is understood that separating the desirable active vapors from the malodorous vapors would be a complex task. To simplify the appliances of this invention a Volume Refreshment Rate has been determined that optimizes the venting of malodorous compounds while minimizing the loss of active components from the cleaning and refreshment composition.

The Volume Refreshment Rate is defined as the frequency that the total volume of air within the interior void space of the container is replaced, expressed in units of seconds$^{-1}$. If the appliance vents substantially lower than 0.0004 $s^{-1}$ then venting becomes too weak, and deodorization performance deteriorates unless the cycle length is drastically increased. Theoretically, one volume refreshment per cycle could be enough to allow good deodorization. Supposing, for example, a cleaning and refreshment cycle takes 1 hour, of which the deodorization step would take approximately 40 minutes, this would mean a VR/s of 0.0004 $s^{-1}$. An exemplary Volume Refreshment Rate calculation is given in Example I below.

The Volume Refreshment Rate for the appliances of the present invention is preferably between about 0.0004 $s^{-1}$ and about 0.05 $s^{-1}$, and more preferably between about 0.001 $s^{-1}$ and about 0.03 $s^{-1}$.

To properly clean and refresh a fabric article, one must address many aspects of the article's appearance. Specifically, the fabric article should at least be substantially free of odor and wrinkles after a cleaning and refreshing operation. It is often preferred that the article be perfumed to give it a pleasant odor, and it should be free of localized stains. The methods of this invention require at least two steps designed toward deodorizing, dewrinkling and/or perfume deposition on a fabric article. Additionally, a manual spot removal process for removing localized stains is provided, but the spot removal process is conducted outside of the appliance, by means of the built-in ultrasonic pre-treatment device as described hereafter. The use, where necessary, of this built-in pre-treatment device should be considered as an optional part of the method of treating fabric garments, in the context of the present invention. Such a pre-treatment implement—or device—should be used, where necessary, to remove localized stains onto the fabric garments, prior to placing said garments inside the container (12) of the appliance (10) and prior to starting a refreshing/cleaning cycle. Once the user has had the opportunity to remove localized stains from garments, the refreshing/cleaning cycle per se—i.e. inside the closed container (12) of the appliance (10) can start, whose steps are described hereafter in more detail.

While the method steps of this invention can be carried out in any appropriate order, the deodorization step will be discussed first. Deodorization must be distinguished from odor masking, which involves applying a pleasant scent to a fabric to mask, or cover up the odors on the fabric. Deodorization, as used herein, involves the actual removal or degradation of malodor causing chemicals. When the malodor causing constituents are removed or neutralized, the fabric article should have little or no residual odor. This step of the process can be carried out with ozone, which degrades odors, or with high temperatures and venting which removes the odor causing constituents.

The deodorization step is described herein as the first step as a matter of convenience. It is understood that the deodorization and dewrinkling steps can be carried out in any order. If a perfume deposition step is employed, it necessarily should follow the deodorization step, so that the perfume is not stripped off of the fabric immediately after it is laid down.

Thus, when deodorization is the first step, the first temperature should be at least about 45° C., preferably at least about 60° C., and most preferably at least about 70° C. and the first relative humidity should be least about 20%. At these relatively high temperatures, odor-causing chemicals are stripped off of fabrics, and then preferably removed from the container via the vent. Even more preferably, the vent comprises a filter so that the odorous emanations do not enter the environment outside of the container. When the first temperature and first relative humidity are reached, the process time, that is, the first time, can be from about 2 minutes to about 20 minutes, preferably from about 5 minutes to about 15 minutes, and even more preferably from about 8 minutes to about 12 minutes.

The deodorization step described above can be supplemented, or even replaced by treating the fabric articles with ozone. The use of ozone to neutralize odors causing chemicals and to sanitize garments, for example, medical gowns, is well known to the art. Specifically see, published patent applications DE 24 33 909 and FR 2059 841, both of which are incorporated herein by reference. For purposes of the methods disclosed herein, ozone can be introduced into the container from any appropriate source, such as an ultraviolet lamp or even a high voltage source. One or more ozone sources can be used and they can be placed in any convenient place in, or adjacent the exterior of the container. The ozone source must be sized according to the volume of the container with consideration for the surface area of the fabric articles being cleaned and refreshed. An alternative way to produce ozone for deodorization is the use of high voltage. For example, a wire can be placed in the container and approximately about 10,000 volts passed across the wire. This generally serves the same purpose as the UV lamp generating ozone. Those skilled in the art will know what type and size of equipment to use for a given container.

The second step of the present invention is directed to dewrinkling, which requires relatively high temperature and relative humidity. Good air circulation that agitates the fabrics and evenly distributes the active ingredients is beneficial to the dewrinkling step, but not necessary. For the second step, i.e. the dewrinkling step, the second temperature should be greater than "T" as defined by the equation: $T=60-(0.17*RH_2)$, wherein $RH_2$ is the second relative humidity in percent. $RH_2$ is of at least 50%, preferably of at least 75%, more preferably of at least about 85%, most preferably at least about 90%. Preferably, the second temperature is less than about 90° C., more preferably less than about 80° C., and most preferably less than about 70° C. When the second temperature and second relative humidity are reached, the process time, that is, the second time, can be from about 2 minutes to about 20 minutes, preferably from about 5 minutes to about 15 minutes, and even more preferably from about 8 minutes to about 12 minutes.

Finally, there is preferably a third step, which involves a gradual cool down of the interior void space. As the temperature decreases, the amount of vapor that the air can retain in the air decreases, and when the air becomes saturated the vapors begin to condense. Naturally, vapors will condense on the fabric articles on the inside of the bag, and as these articles dry, the active ingredients, such as perfume, remain behind. As discussed briefly above, the methods steps of this invention are designed to deliver actives without undue waste and without saturating the fabrics to the point where they need additional drying. Preferably, during the third step in the process the temperature within the interior void space decreases to a third temperature wherein the third temperature is less than about 45° C., preferably less than about 40° C., and more preferably less than about 35° C. This third step can last for a third period of time, which can be from about 2 minutes to about 20 minutes, preferably from about 3 minutes to about 10 minutes, and even more preferably from about 3 minutes to about 5 minutes.

As discussed in greater detail below, the vapor inside the container is preferably a cleaning and refreshment composition. The cleaning refreshment composition can be added to the container directly, via a sheet/substrate, in a cartridge or any other means that will be known to those skilled in the art. Preferably, the cleaning and refreshment composition is in a cartridge that is introduced into the interior void space of the container and the cleaning and refreshment composition is released from the cartridge into the interior void space of the container.

Preferably, the refreshing/cleaning appliance will be delivered to the user with a set a instructions for using the product with fabric garments. This set of instructions will include instructions for the treatment of garments in a refreshing/cleaning cycle inside the closed container, but also, instructions on how to pre-treat garments that would comprise localized stains, to be removed with the built-in hand-held ultrasonic implement. The instructions will generally be in line with the method described in the present description, however, the description of the method of treatment given herein should not be limiting.

Optionally, but preferably, the refreshing/cleaning appliance (10) with built-in ultrasonic pre-treatment device, according to the present invention, will be delivered to the user under the form of a kit, comprising for example, a refreshing/cleaning appliance (10) as described herein, together with a set of instructions, at least one container—or cartridge—(52) of refreshing/cleaning composition, and a package containing wipes to be used as stain receivers together with the pre-treatment ultrasonic hand-held implement.

The cleaning/refreshment composition preferably comprises water and optionally a member selected from the group consisting of surfactants, perfumes, preservatives, bleaches, auxiliary cleaning agents, shrinkage reducing compositions, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol, ethanol, isopropanol, wrinkle removing agents, in-wear anti-wrinkling agents, semi-durable press agents, odor absorbing agents, volatile silicones and mixtures thereof. Fabric shrinkage reducing compositions that are suitable for use in the present invention are selected from the group consisting of ethylene glycol, all isomers of propanediol, butanediol, pentanediol, hexanediol and mixtures thereof. More preferably, the fabric shrinkage reducing compositions are selected from the group consisting of neopentyl glycol, polyethylene glycol, 1,2-propanediol, 1,3-butanediol, 1-octanol and mixtures thereof. The surfactant is preferably a nonionic surfactant, such as an ethoxylated alcohol or ethoxylated alkyl phenol, and is present at up to about 2%, by weight of the cleaning/refreshment composition. Preferred auxiliary cleaning agents include cyclodextrins and dewrinkling agents, such as silicone containing compounds. Especially preferred anti-wrinkling agents include volatile silicones, some of which can be purchased from the Dow Corning Corporation. One such volatile silicone is D5 cyclomethicone decamephyl cyclopenta siloxane. Typical fabric cleaning/refreshment compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. The entire disclosure of the You et al. patent is incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference. And shrinkage reducing compositions for use in this invention can be found in co-pending U.S. Provisional Application No. 60/097,596, entitled "Cleaning Compositions that Reduce Fabric Shrinkage", which was filed by Strang and Siklosi, on Aug. 24, 1998. The entire disclosure of the Strang and Siklosi application is incorporated herein by reference.

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions that are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning methods and compositions are described in U.S. Pat. No. 5,789,368, to You et al. which was incorporated herein by reference above. Additionally, spot cleaning methods and compositions are described in U.S. Pat. No. 5,630,847, which issued on May 20, 1997, to Roetker.

The following table gives an example of one composition suitable for use with the built-in pre-treatment implement described herein, for stain-removal prior to refresh/clean the garments into the closed container (12).

| Order of addition | % Active | Raw Material | % in formula |
|---|---|---|---|
| 1 | 30 | Dawn-Base mixture below containing: | 2 |
| | | Sodium Lauryl sulfate paste (70% AE1S) | 28.6 |
| | | Ethanol | 6.275 |
| | | Alkyldimethylamine oxide | 3.514 |
| | | Sodium Xylene Sulfonate | 3.012 |
| | | Magenesium sulfate-crystalline epsom salts (MgSO4-7H2O) | 0.382 |
| | | Magnesium chloride solution | 0.452 |
| | | Citric acid anhydrous | 0.050 |
| | | Water | 57.715 |
| 2 | 100 | BPP Butoxy-propoxy-propanol | 2 |
| 3 | 99.5 | EDTA | 0.005 |
| 4 | 35 | Alkaline $H_2O_2$ stabilizer 1 (Solvay Interox) | 2.5 |
| 5 | 100 | Miraflor perfume dissolved in EtOH | 0.51 |
| | | Miraflor | 0.01 |
| | | EtOH | 0.5 |
| 6 | 100 | Water | 93.98 |
| | | Formula pH* | 9 |

*add trace of NaOH 50% to have a pH 9

It is a preferred feature of the refreshing/cleaning appliance (10) according to the present invention, that it comprises a built-in pre-treatment implement—or device—to assist in removing localized stains from fabrics. It is also essential to the present invention that said pre-treatment implement be hand-held. By hand-held, it is meant that while said implement is built-in, i.e. attached and not removable from the appliance (10), it must be carried and manipulated by the user, for example, like a pen that is linked to the main appliance (10) by a wire (55). The pre-treatment ultrasonic device as described in the context of the present invention is built-in with the fabric refreshing/cleaning appliance (10), as it is part of the general process of refreshing/cleaning garments, that the user be able, where necessary, to use a device to remove tough localized stains prior to placing the garments in the main fabric treatment container (12). Preferably, as shown in FIG. 1, the fabric pre-treatment ultrasonic device of the invention is normally arranged in a compartment (35) located in the top rigid portion (42) of the said container (12).

In addition, it has been found that an ultrasonic implement has the advantage of providing a very efficient means to remove difficult stains, while having a shape and size that is compatible with the fact that it must be held in hand by the user during use, and then arranged in a compartment (35) of the refreshing/cleaning appliance (10). The ultrasonic technology is compatible with these two conditions. In a preferred embodiment of the present invention, said hand-held ultrasonic pre-treatment implement has an active part (i.e. sonotrode) (56) vibrating at a frequency of at least 20 kHz with an amplitude of at least 10 $\mu$m and up to 100 $\mu$m. It is preferably shaped generally like a pen, and is attached to the main appliance by a wire (55) that provides power to the ultrasonic part. Also preferably, the wire (55) comprises a pipe that is capable of transporting a composition to the ultrasonic sonotrode, to be dispensed to the stain being treated, in order to enhance the spot-removal process.

An example of the structure for the ultrasonic implement for pre-treatment of fabrics is hereafter given. The ultrasonic implement comprises a handle, a wire that is attached to the main refreshing/cleaning appliance, said wire conducting the power to generate ultrasounds from the sonotrode, and the sonotrode itself that is located at the distal end of the handle. In this example, the acoustic system, which generates the ultrasonic waves is made from a piezo-ceramic element or elements, typically called PZTs, along with an acoustic amplifier, typically called an acoustic horn or acoustic transducer or sonotrode. The entire acoustic system is designed to operate at a specific frequency and power and deliver a predetermined amplitude at the end or tip of the sonotrode. The combination of the sonotrode design, amplitude, frequency and power dictates the cleaning efficacy. Further, not all of the parameters are independently chosen. With regards to the design of the sonotrode, a variety of different shapes provide improved cleaning benefits. One specific embodiment is a "chisel" design, where the sonotrode is tapered at the end that will contact, or be proximate to, the stain/soil to be removed. Typically, the width of the sonotrode is much less than its length. For example the sonotrode may be 0.05 to 5 mm wide and is 10 to 50 mm long. In one embodiment, cleaning is improved when the sonotrode is designed to deliver equal amplitude across the sonotrode blade. However, there are other embodiments where having a higher localized amplitude is preferred. In one embodiment, it has surprisingly been found that a sonotrode blade in a "chisel" shape running at 50 kHz, 30 Watts and 40 microns provides significant cleaning benefits. In another example, it has surprisingly been found that sonotrodes designed in a "disc" or round shape deliver significant cleaning benefits. This sonotrode embodiment typically has a disc radius of from 10 to about 100 mm. Further, the sonotrode may present a more three dimensional appearance to the stain/soil to be cleaned. The sonotrode may be in the shape of a hemisphere or may be disc shaped with undulations or dimples on the surface. In another examples, the sonotrode can be rectangular, oval, or triangular shaped. Because of ergonomic considerations, it is preferred that the sonotrode have rounded edges. Each of these different embodiments offers unique cleaning opportunities. In addition, the mass of the sonotrode is important to achieve the desired cleaning benefit. It has surprisingly been found that the sonotrode must have a mass between 20 and 500 grams. Further, the sonotrode material must be chosen to have the desired acoustic properties and also be compatible with the chemistry being used in the cleaning application. Suitable materials include titanium, aluminum and steel, preferably hardened steel. Less preferred, but acceptable for cleaners that are substantially free from bleaches and alkalinity is aluminum.

The built-in pre-treating implement is intended to be used jointly with a stain-removing composition, whose efficacy is enhanced by the ultrasounds. Said stain-removal composition can either be brought to the stain via a conducting pipe that brings said composition from a reservoir located in the main appliance (10), said pipe being preferably joint to the main power wire (55), or alternatively, said composition is contained in a pre-treatment wipe—or stain receiver—that is placed under the garment to be treated, while the sonotrode is placed onto said garment. The latter pre-treatment method is preferred, and shown in FIGS. 2 and 3. The stain receivers can be of any suitable form and shape, and include, but are not limited to, sponges, scouring pads, steel wool pads, high friction non-wovens, and absorbent natural and synthetic materials. These stain receivers can help cleaning by removing the soils and stains that are loosened by the ultrasonic plus chemistry, and/or they can act to absorb residual stains and/or hold the cleaning solution in close contact with the stain or soil which is in contact with the ultrasonic energy. Optionally, these adjunct pads can be removable and/or disposable.

In one embodiment—which is just given as an example for the structure of a suitable pre-treatment implement, and is not intended to be limiting—, the transducer oscillates at a frequency of from about 100 Hz to about 20,000 kHz, more preferably from about 100 Hz to about 10,000 kHz, more preferably from about 150 Hz to about 2000 kHz, more preferably from about 150 Hz to about 1,000 kHz, more preferably from about 150 Hz to about 100 kHz, more preferably from about 200 Hz to about 50 kHz. It is preferred that the average frequency be from about 1000 Hz to about 100 KHz, more preferably from about 15 kHz to about 70 kHz. It is also preferred that the pre-treatment implement provides a power output per unit of surface area of the cleaning head of at least about 5 watts/$cm^2$, more preferably at least about 10 watts/$cm^2$, even more preferably at least about 25 watts/$cm^2$, even more preferably still at least about 50 watts/$cm^2$. The ultrasonic waves will have amplitude of, for example, from about 10 microns to about 100 microns, more preferably from 20 to 60 microns.

Typical treatment times range from about 1 second to about 10 minutes, more typically from about 10 seconds to about 5 minutes, more typically from about 20 seconds to 2 minutes, even more typically from about 30 seconds to about 1 minute, although treatment times will vary with the severity of the stain or toughness of the soil, and the surface from which the soil/stain is being removed. The ultrasonic source device can be, for example, a vibrational ultrasonic generator, a torsional ultrasonic wave generator, or an axial ultrasonic generator in that it is the shock waves generated by these ultrasonic sources that does the actual cleaning or loosening of the stain on the textile regardless of the mechanism by which the ultrasonic shock waves are generated.

Preferably, and especially in case the ultrasonic built-in pre-treatment implement is used with cleaning or stain-removing compositions containing bleach compounds, the ultrasonic horn, or sonotrode, will be kept at a temperature of from about 30° C. to 100° C., so as to activate the bleach and enhance the stain-removing efficacy of the composition. More preferably, said composition is regulated within a range of 35° C. to 60° C.

Such an ultrasonic pre-treatment device should be used, when necessary, to remove tough and localized stains on fabric garments, prior to placing said garments within said fabrics refreshing/cleaning appliance (10). Indeed, it has been found that some localized stains are difficult to remove by a mere refreshing/cleaning cycle into the appliance (10), and such a pre-treatment ultrasonic device, as described above has been found surprisingly efficient in treating fabric garments and removing tough stains, especially in combination with the additional use of a refreshing/cleaning appliance (10) as described herein. In a preferred embodiment of the present invention, the pre-treatment ultrasonic device is used in combination with a pre-treatment wipe or stain receiver, as further described hereafter and as shown in FIGS. 2 and 3. More preferably, said wipe releasably contains a cleaning composition, to help removing localized stains from the fabric garments. As shown in FIGS. 2 and 3, such a wipe is held in one hand by the user under the portion of garments to be pre-treated, while the user holds the pre-treatment device in the other hand, and presses firmly onto the stain, preferably with a back and forth movement until said stain has disappeared.

An absorbent stain-receiving article, sometimes referred to herein as a stain receiver, can optionally be used in the optional pre-spotting operations herein. Such stain receivers can be any absorbent material that imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAL"). Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Ser. No. 60/077,955, filed Mar. 13, 1998 by T. A. DesMarais, et al., titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

We claim:

1. An appliance for treating at least one cloth item comprising:

a collapsible or expandable container comprising a flexible material, the container defining an interior space for enclosing the at least one cloth item;

a container opening in the flexible material for accessing the interior space;

a humidity provider;

a heating element;

at least one vent;

an air circulation device;

a sealing fastener operable between an opened and a closed condition for selectively opening and closing the container opening; and an interlock comprising a controller operably coupled to the fastener for locking the fastener in the closed condition during the operation of a refreshing/cleaning cycle to prevent accidental opening of the container during the refreshing/cleaning cycle.

2. The appliance according to claim 1, wherein the interlock comprises a locking mechanism operable between a locked and an unlocked condition and operably coupled to the fastener such that when the fastener is in the closed condition and the lock mechanism is in the locked condition, the fastener cannot be moved to the open condition until the lock mechanism is in the unlocked condition.

3. The appliance according to claim 2, wherein the controller controls the refreshing/cleaning cycle and is operably coupled to the locking mechanism such that the controller prevents changing the locking mechanism from the locked to the unlocked condition during the refreshing/cleaning cycle.

4. The appliance according to claim 3, wherein the fastener comprises a zipper.

5. The appliance according to claim 3, wherein the fastener comprises a vertical zipper and at least one horizontal zipper extending laterally therefrom and the container opening is in the opened condition when the vertical zipper and the at least one horizontal zipper are in an unzipped position.

6. The appliance according to claim 5, wherein the at least one horizontal zipper can only be unzipped with the vertical zipper in the unzipped position.

7. The appliance according to claim 3, wherein the locking mechanism comprises a reciprocating pin operable between an extended position, wherein the pin engages the fastener in the closed condition to prevent the movement of the fastener to the opened condition, and a retracted position, wherein the fastener is free to move to the opened condition.

8. The appliance according to claim 7, wherein the locking mechanism further comprises a driver for reciprocating the pin between the extended and retracted positions.

9. The appliance according to claim 8, wherein the driver comprises one of a wax motor and a solenoid operably coupled to the controller.

10. The appliance according to claim 3, and further comprising a sound indicator that emits sound during the refreshing/cleaning cycle.

11. The appliance according to claim 10, wherein the sound indicator is operably coupled to the controller, which adjusts the intensity of the emitted sound to indicate the progress of the refreshing/cleaning cycle.

12. The appliance according to claim 11, wherein the intensity of said sound is not higher than 70 dB.

* * * * *